United States Patent [19]

Agnew

[11] Patent Number: 4,563,311

[45] Date of Patent: Jan. 7, 1986

[54] CARBURETOR VALVE

[75] Inventor: Ralph E. Agnew, Gardena, Calif.

[73] Assignee: McCulloch Corporation, Los Angeles, Calif.

[21] Appl. No.: 582,821

[22] Filed: Feb. 23, 1984

[51] Int. Cl.[4] ..... F02M 17/04

[52] U.S. Cl. ..... 261/35; 261/39 B; 261/DIG. 68; 261/DIG. 81

[58] Field of Search ..... 261/DIG. 68, DIG. 81, 261/35, 39 B

[56] References Cited

U.S. PATENT DOCUMENTS

| | | | |
|---|---|---|---|
| 2,341,694 | 2/1944 | Coffey | 261/DIG. 38 |
| 2,621,909 | 12/1952 | Stearns | 261/39 B |
| 3,235,238 | 2/1966 | Martin et al. | 261/DIG. 68 |
| 3,719,322 | 3/1973 | Gifford | 261/DIG. 38 |
| 3,920,776 | 11/1975 | Wildt-Persson et al. | 261/DIG. 68 |
| 4,268,461 | 5/1981 | Onishi et al. | 261/39 B |
| 4,360,481 | 11/1982 | Kaufman | 261/DIG. 68 |

FOREIGN PATENT DOCUMENTS

| | | | |
|---|---|---|---|
| 54-16022 | 6/1979 | Japan | 261/DIG. 81 |
| 55-112844 | 9/1980 | Japan | 261/DIG. 81 |
| 58-85356 | 5/1983 | Japan | 261/DIG. 81 |

*Primary Examiner*—Tim Miles

*Attorney, Agent, or Firm*—Murray, Whisenhunt and Ferguson

[57] ABSTRACT

A diaphragm carburetor provided with a temperature-sensitive lever arm is disclosed. The temperature-sensitive lever arm permits hot restart of an engine when the carburetor is in a vapor lock condition, without the use of the choke mechanism.

25 Claims, 4 Drawing Figures

CARBURETOR VALVE

BACKGROUND OF THE INVENTION

1. Field of the Invention

This invention relates to diaphragm carburetors. More particularly, this invention relates to overcoming problems with the hot restart (vapor lock) of small gasoline engines equipped with diaphragm carburetors.

2. Description of the Prior Art

The hot restart of a gasoline engine, after several minutes the heat "soakback" (equilibration of carburetor temperature with engine temperature), may be very difficult due to the induction of a "vapor lock" condition. Vapor lock is a partial or complete stoppage of fuel flow to the carburetor caused by the formation of gasoline vapor in the fuel system. Partial vapor lock increases the top speed and reduces the power of an engine because the air/fuel mixture is leaned out by the reduced flow of liquid gasoline.

Vapor lock is affected by the following factors:

(1) Temperature and pressure of the gasoline in the fuel system.

(2) Vapor-forming characteristics of the gasoline.

(3) Ability of the fuel system to handle vapor.

(4) Engine operating conditions.

Motor gasolines are composed of liquid hydrocarbons that generally boil between 90° F. and 400° F. under laboratory conditions, e.g., under sea-level atmospheric conditions. Significant amounts of such fuels boil at 135°–140° F. At an altitude of 5,000 feet above sea-level, due to lowered barometric pressure, fuel vaporization occurs at a temperature which is approximately 12° F. lower than sea-level values. Likewise, within the fuel system, fuel system pressure affects vapor formation at a given temperature, increasing amounts of vapor being formed as the pressure is lowered.

Various attempts have been made to compensate for and/or correct the vaporization of fuel in the fuel system.

Coffey, U.S. Pat. No. 2,341,694, discloses a carburetor for internal combustion engines with compensating means for variations in the flow of volatile liquid fuels due to temperature change. In particular, Coffey is concerned with down-draft carburetors which, due to their location with respect to the engine, become heated to such an extent during high speed driving on warm days that the usually available fuels, upon being received in the carburetor constant level chamber, immediately become charged with vapor bubbles. This formation of vapor bubbles causes less fuel to pass through the carburetor metering orifices than if the fuel were cool and not boiling, resulting in a leaning out of the air/fuel mixture being passed to the engine, and frequently, causes the objectionable irregularity of engine operation known as surging. In order to overcome this difficulty, Coffey provides a main carburetor body member having a mixture conduit therethrough. The mixture conduit is provided with a venturi formed restriction and two concentric venturi tubes suspended therein. The outlet of the mixture conduit is controlled by a plate-type throttle valve mounted for rotation with a throttle shaft. Adjacent the mixture conduit and formed as an integral part of the body member is a constant level fuel chamber equipped with a float which acts upon an intake needle valve to maintain a substantially constant level of fuel therein. Attached to the body member is a combination air inlet and fuel chamber cover casting having an air inlet to the mixture conduit formed therein. For control of the air inlet, an unbalanced plate-type choke valve rigidly attached to a rotatable choke shaft is provided. A bimetallic temperature responsive spiral which has its inner end attached to the choke shaft and its outer end attached to a stop is provided for urging the choke toward a closed position with decreasing temperature. Discharging into the venturi tube is a main fuel nozzle which receives fuel from the constant level fuel chamber through a metering orifice and passage. Extending through the orifice is a stepped and tapered metering rod arranged to be moved vertically to vary the net opening of the orifice. A link mechanism is provided for positioning the metering rod in accordance with the position of the throttle valve. In order to compensate for the reduction in flow through the orifice at high temperatures, at which the fuel becomes charged with vapor bubbles, the metering rod is constructed in two sections which are joined by a bimetallic temperature responsive loop. The loop is so constructed as to raise the lower end of the metering rod with increasing temperature and thereby increase the net opening of the orifice for any given position of the throttle valve. Alternatively, two orifices can be provided, the metering rod for one orifice being controlled solely in relation to the position of the throttle valve and the metering rod for the other orifice being controlled solely in response to temperature.

Korte, U.S. Pat. No. 3,186,470, discloses a thermostatic valve for fuel pumps. In particular, conventionally, a fuel system for an internal combustion engine comprises a source of fuel (e.g., a fuel tank), a carburetor for providing the appropriate emulsification of the fuel and its mixture with air, and a pumping means for bringing the fuel from the fuel source to the carburetor. The pumping means, in automobiles, normally is a diaphragm-operated fuel pump located between the fuel tank and the carburetor. When a car is slowed down to a stop, the carburetor fuel bowl fills and the needle valve in the carburetor closes the fuel line from the pump. The pump then builds up pressure of fuel in the line between the pump and the carburetor to a point where the fuel pressure holds the pump out of operation, since the fuel is pumped by spring action rather than a positive action from the pump driving cam of the engine. Thus, upon stopping of the car, fuel between the carburetor and the pump under the spring pressure of the pump will be exposed to the elevated ambient temperature associated with engine heat to an extent that fuel pressure will build up and force fuel through the carburetor into the fuel bowl. The increase in the amount of fuel in the fuel bowl will permit the fuel to run out through the fuel nozzle into the intake manifold of the engine and, upon restarting of the engine, the excessive amount of fuel in the intake manifold results in a difficult starting of the engine. Korte overcomes this problem by providing a thermostatically controlled relief valve on the fuel pump feeding vapors back to the fuel tank and a constant bleed-back to the fuel tank. Under high temperature conditions, the relief valve allows fuel vapors to be passed to the fuel tank, while the constant bleed prevents pressure build-up in the fuel line to the carburetor during shutdown of the engine.

While the above-noted patents provide solutions to the problem of vapor lock for the conventional fuel systems utilized in automobiles, they do not solve the vapor lock problem for diaphragm carburetors typically utilized for two-cycle engines.

In particular, such diaphragm carburetors do not utilize movable stepped and tapered metering rods for control of fuel flow to the fuel nozzles, from a constant level fuel supply, in response to throttle opening; but rather utilize preset metering orifices (e.g., needle valves) which are fed from a fuel chamber which is kept liquid-full by a valve mechanism which is pressure actuated. (The pressure actuation mechanism being disabled with the presence of vapor in the fuel chamber.) Moreover, the diaphragm pumps (actuated by crankcase pressure pulsations) utilized in such diaphragm carburetors would only have their pumping efficiency decreased by provision of a vapor by-pass and/or continuous bleed.

Such diaphragm carburetors are disclosed in Barr, U.S. Pat. No. 3,104,617, and Beck, U.S. Pat. No. 3,269,713.

Additionally, while it is true that the vapor lock condition of such a diaphragm carburetor can be overcome by the use of a manual choke, the two-cycle engines utilizing such carburetors are usually equipped with manual starting mechanisms, e.g., a starting rope. Even utilizing full choke, 10–20 pulls of the starting rope may be necessary of a restart of the engine. This is obviously undesirable in the course of daily use of an engine whih may be repeatedly started and stopped, e.g., a chain saw.

Accordingly, a need continues to exist for a mechanism to avoid the hot restart problems of a vapor locked engine.

BRIEF SUMMARY OF THE INVENTION

The present invention comprises a carburetor for supplying a mixture of an oxygen-containing gas and a liquid, at least partially vaporizable fuel to an internal combustion engine having a crankcase, the carburetor comprising:

passage means for introducing an oxygen-containing gas, having a given pressure, to the intake manifold of an internal combustion engine;

pressure-reducing means, operably connected to the passage means, for reducing the pressure of the oxygen-containing gas within the passage means;

fuel mixing means, operably connected to the passage means, for mixing the fuel with the oxygen-containing gas;

fuel control means for supplying a controlled amount of the fuel to the fuel mixing means; and throttle means, operably connected to said passage means, for controlling the amount of the mixture of gas and fuel supplied to the internal combustion engine;

wherein the fuel control means includes:

fuel regulator means, operably connected to the fuel mixing means, for containing a predetermined quantity of the fuel;

pressure control means, for varying the amount of fuel fed to the fuel mixing means in response to the pressure differential between the reduced-pressure gas and the gas having a given pressure; and temperature control means for varying the amount of fuel fed to the fuel mixing means in response to the temperature of the fuel in the fuel regulator means.

BRIEF DESCRIPTION OF THE DRAWING FIGURES

DETAILED DESCRIPTION OF THE PREFERRED EMBODIMENTS

Figure 1:
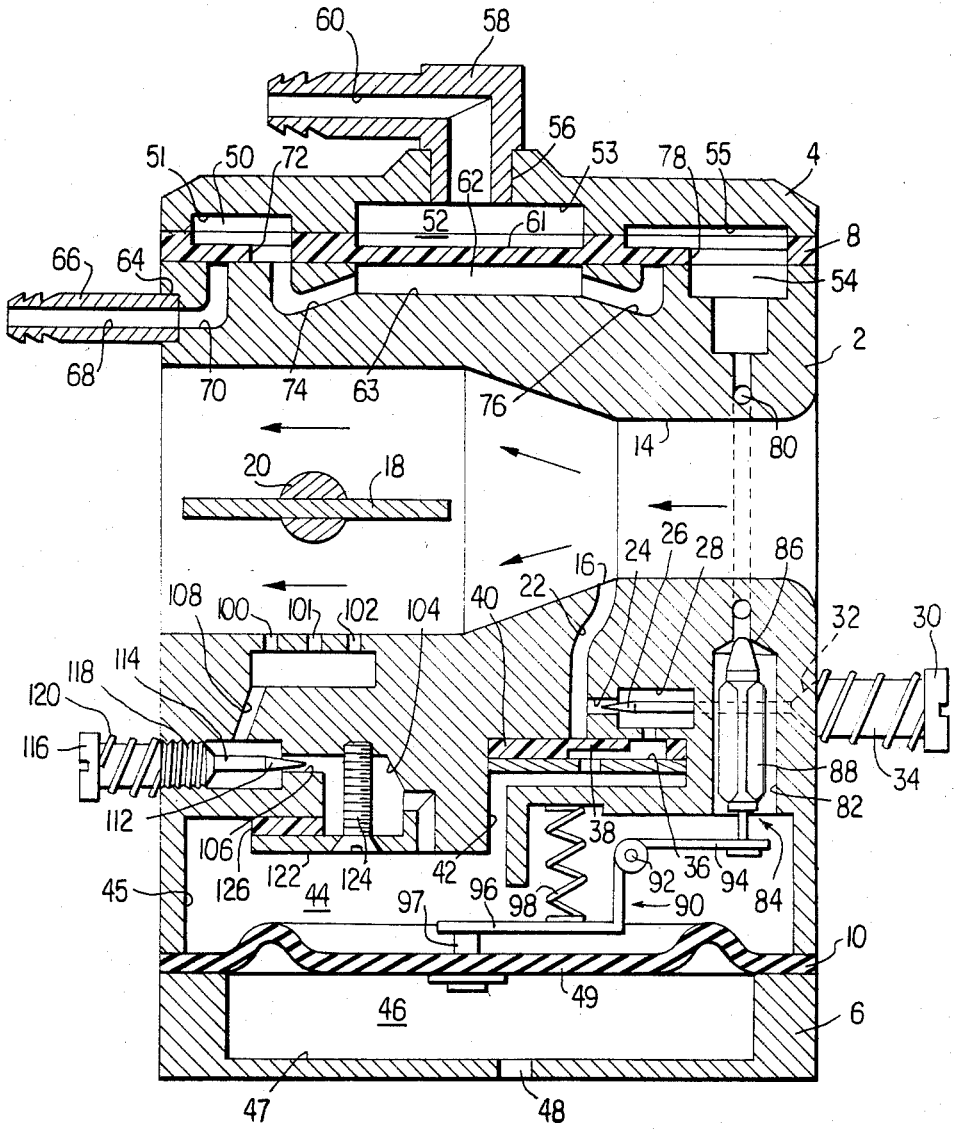
FIG. 1 is a sectional view of a diaphragm carburetor according to the present invention.

Referring to the drawings, FIG. 1 shows a sectional view of a diaphragm carburetor according to the present invention. In particular, the carburetor, generally indicated as 1, comprises a main body 2, a pump plate 4 and a regulator plate 6. The pump plate 4 is connected to the main body 2 by means of bolts or screws (not shown) with a flexible pump diaphragm 8 interposed between the pump plate 4 and the main body 2. The pump diaphragm 8 is cut to fit passages and recesses formed in both the main body 2 and the pump plate 4, as will be explained hereinafter. The regulator plate 6 is connected to the main body 2 by means of bolts or screws (not shown) with a flexible regulator diaphragm 10 interposed between the regulator plate 6 and the main body 2. The main body 2 of the carburetor has a passageway, generally indicated as 12, formed therein for flowing an oxygen-containing gas, e.g., air, from a constant pressure source of oxygen-containing gas (not shown), e.g., the ambient atmosphere, to the intake manifold of an internal combustion engine (not shown). The direction of flow of the oxygen-containing gas is shown by the solid arrows.

A pressure-reducing means is operably connected to the passageway 10. As illustrated, this pressure-reducing means comprises a flow constriction in the form of a venturi, generally indicated as 14. As is well known, such a venturi 14 operates to constrict the flow area of the oxygen-containing gas through passageway 10, thereby increasing its linear velocity and concomitantly reducing the pressure of the oxygen-containing gas.

A fuel mixing means, in the form of a main fuel nozzle 16, is operably connected to the passageway 12 for supplying a liquid, at least partially vaporizable fuel to the flowing oxygen-containing gas. The fuel supplied by the main fuel nozzle 16 is broken up into fine droplets by the flowing oxygen-containing gas and carried along with the flowing gas to the intake manifold of the internal combustion engine.

A throttle means, comprising a butterfly-type valve 18 mounted for rotation with a throttle shaft 20 is provided within passageway 12 to control the amount of the mixture of oxygen-containing gas and fuel flowing to the intake manifold of the engine. The throttle shaft 20 is connectable through a conventional linkage (not shown) to a conventional throttle control mechanism (also not shown).

Fuel passes to main nozzle 16 through fuel conduit 22 formed in the main body 2 of the caburetor. Fuel flow through fuel conduit 22 is limited by orifice 24, the relative cross-sectional opening of orifice 24 being set at a predetermined value by the positioning of tapered needle point 26 within the orifice. Tapered needle point 26 is formed on the end of screw extension 28 which in turn is formed on the end of screw 30. Screw 30 engages threaded bore 32, and rotation of the screw 30 causes adjustment of the position of tapered needle point 26 with respect to orifice 24 thereby controlling the cross-sectional area of orifice 24 available for fuel flow. Screw 30 is wound about by spring 34 which applies force against the screw 30 so as to force the threads of the screw 30 against the threads of threaded bore 32, thereby providing increased frictional force between screw threads and bore threads to prevent rotation of the screw when subjected to vibration, as when the engine is running, and to aid in the formation of a fuel-tight seal between screw 30 and threaded bore 32.

Fuel is fed to orifice 24 through conduit 36 fitted with check valve 38. Check valve 38 is formed from a cut flap of a flexible diaphragm 40. Check valve 38 allows fuel to flow through conduit 36 to orifice 24 and hence to conduit 22 and the main fuel nozzle 16. If there is a flow reversal, check valve 38 folds down to close off conduit 36.

Fuel is fed to conduit 36 through conduit 42 which in turn is connected to regulator chamber 44. Regulator chamber 44 is formed as a recess 45 in the main body 2 of the carburetor, the recess being closed by regulator diaphragm 10 disposed between main body 2 and regulator plate 6. Opposite regulator chamber 44, an air chamber 46 is formed as a recess 47 in regulator plate 6. Air chamber 46 is in communication with the constant pressure source of oxygen-containing gas through hole 48 in regulator plate 6. (Typically, where the oxygen-containing gas is air, hole 48 is merely open to the ambient atmosphere.) Regulator diaphragm 10 forms a common flexible wall 49 separating regulator chamber 44 from air chamber 46.

In a similar manner, valve chamber 50, crankcase chamber 52, and valve chamber 54 are formed as recesses 51, 53 and 55, respectively, in pump plate 4. Recess 53, forming crankcase chamber 52 is closed by pump diaphragm 8 disposed between the main body 2 of the carburetor and pump plate 4. Crankcase chamber 52 is provided with bore 56 fitted with a nipple 58 containing passage 60. Passage 60 can be connected to the crankcase of the internal combustion engine (not shown) by a hollow tube (also not shown) fitted over nipple 58.

Fuel chamber 62 is formed as a recess 63 in main body 2, and is closed by pump diaphragm 8 disposed between main body 2 and pump plate 4. Pump diaphragm 8 forms a common flexible wall 61 separating fuel chamber 62 from crankcase chamber 52.

Main body 2 is provided with a bore 64 which receives nipple 66 containing passage 68. Passage 68 can be connected to the fuel tank for the engine (not shown) by a hollow tube (also not shown) fitted over nipple 66. Passage 68 is connected to valve chamber 50 via conduit 70, formed in main body 2, and fitted with check valve 72. Check valve 72 is formed from a cut flap of pump diaphragm 8 and allows fuel flow from conduit 70 into valve chamber 70, but prevents flow from valve chamber 50 into conduit 70.

Valve chamber 50 is connected to fuel chamber 62 by conduit 74 formed in main body 2. Fuel chamber 62 is in turn connected to valve chamber 54 by conduit 76 formed in main body 2, and fitted with check valve 78. Check valve 78 is formed from a cut flap of pump diaphragm 8 and allows fuel flow from conduit 76 into valve chamber 54, but prevents flow from valve chamber 54 into conduit 76.

Valve chamber 54 is connected to regulator chamber 44 via passage 80 and in turn conduit 82, formed in main body 2.

Conduit 82 is of generally cylindrical shape having a predetermined cross-sectional area. Conduit 82 connects passage 80 with regulator chamber 44. A plug, generally indicated as 84, is provided within conduit 80. Plug 84 is provided with a tapered resilient nose 86 adapted to fit into the junction of passage 80 and conduit 82. Plug 84 is also provided with vanes 88 adapted to maintain plug 84 centered in conduit 82. Plug 84 is axially movable within conduit 82, the axial position of plug 84 determining the degree to which the tapered resilient nose 86 closes the junction of passage 80 and conduit 82. In other words, as the tapered nose 86 is withdrawn from the junction of passage 80 and conduit 82, the cross-sectional area available for fuel flow increases; conversely, as the tapered nose 86 enters the junction, the cross-sectional area available for fuel flow decreases. Thus, by control of the axial position of plug 84 within conduit 82, the fuel flow into regulator chamber 44 can be controlled from a "no flow" condition (tapered nose 86 fully closes the junction of passage 80 and conduit 82) to a "full flow" condition (tapered nose 86 is completely withdrawn from the junction of passage 80 and conduit 82).

The axial position of plug 84, within conduit 82 is controlled by a lever arm, generally indicated as 90. Lever arm 90 is pivotally mounted within regulator chamber 44 for rotation about pin 92. Lever arm 90 is formed of a first arm portion 94, connected to plug 84, and a second arm portion 96 of a generally L-shape. The short leg of the L is connected to the first arm portion and the long leg of the L abuts contact plate 97 mounted in regulator diaphragm 10. A spring 98, mounted within regulator chamber 44, applies a predetermined force on the long leg of the L-shaped second arm portion 96 so as to urge plug 84 to the fully closed position ("no flow" condition).

The carburetor is also provided with an idling system which includes idle nozzles 100, 101 and 102 which discharge into passageway 12, the idle nozzles being longitudinally spaced apart relative to the passageway. Fuel is supplied from the regulator chamber 44 via passage 104, orifice 106, passage 108 and chamber 110 which is directly connected to the idling nozzles. Fuel flow through orifice 106 is set at a predetermined value by the positioning of tapered needle point 112 within the orifice. Tapered needle point 112 is formed on the end of screw extension 114 which in turn is formed on the end of screw 116. Screw 116 engages threaded bore 118, and rotation of the screw 116 causes adjustment of the position of tapered needle point 112 with respect to orifice 106 thereby controlling the cross-sectional area of orifice 106 available for fuel flow. Screw 116 is wound about by spring 120 which applies force against screw 116 so as to force the threads of the screw 116 against the threads of threaded bore 118, thereby providing increased frictional force between screw threads and bore threads to prevent rotation of the screw when subjected to vibration, as when the engine is running, and to aid in the formation of a fuel-tight seal between screw 116 and threaded bore 118.

As shown in the Figure, passage 104 is formed between main body 2 and plate piece 122, which is held in position by one or more screws 124 and which may include gasket 126. This merely illustrates the fact that passages and recesses within the carburetor may be as readily formed from fitted pieces as by formation of integral recesses and passages in a casting.

Figure 2:
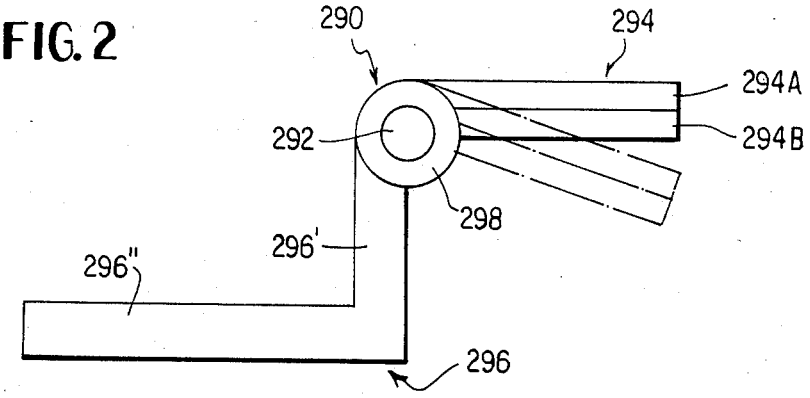
FIG. 2 is a side view of a first embodiment of a lever arm according to the present invention.
Figure 3:
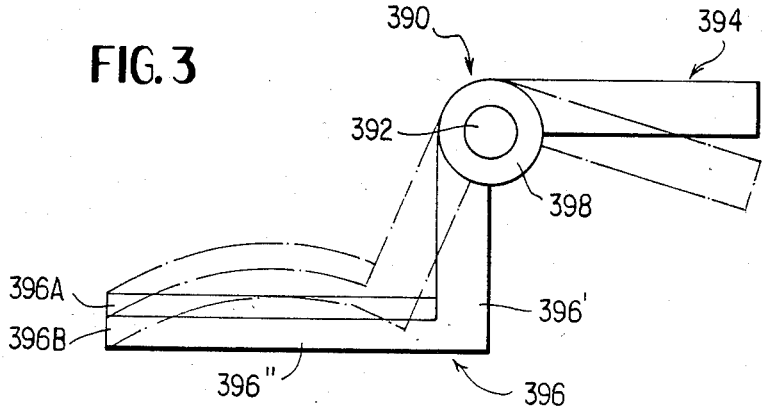
FIG. 3 is a side view of a second embodiment of a lever arm according to the present invention.
Figure 4:
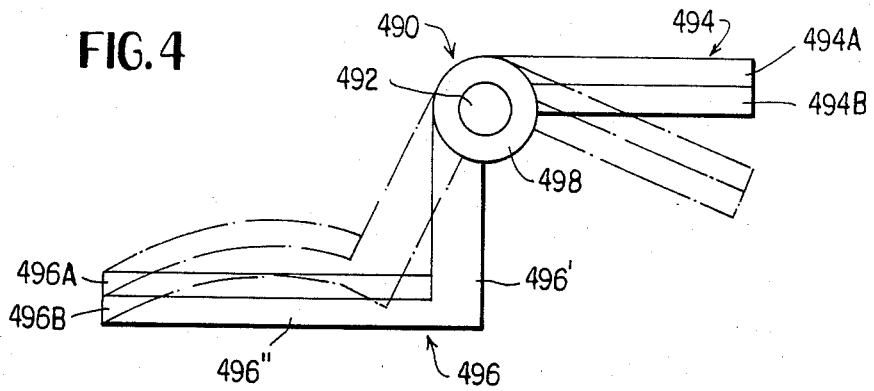
FIG. 4 is a side view of a third embodiment of a lever arm according to the present invention.

FIGS. 2–4 of the drawing show details of the construction of lever arm 90 according to the present invention.

In a first embodiment, FIG. 2 illustrates a lever arm, generally indicated as 290, comprising a first arm portion, generally indicated as 294, and a second arm portion, generally indicated as 296, of a generally L-shape. The short leg of the L 296' is connected to the first arm portion 294 through bushing 298 provided with bore 292 which is receivable of pin 92 (FIG. 1) for pivotally mounting the lever arm 290 within the regulator chamber 44 of the carburetor 1 (FIG. 1). The first arm portion is constructed of an upper half 294A and a lower half 294B. One of the halves, 294A or 294B, is integrally formed with the bushing 298 and the second arm portion 296. The so-formed integral body is made of a first metal having a predetermined linear coefficient of thermal expansion. The remaining half, 294B or 294A, respectively, comprises a metallic strip, formed of a second metal having a predetermined linear coefficient of thermal expansion different from that of said first metal, bonded to the other half. The two bonded halves forming a bimetallic strip which will undergo deformation (by the production of differential expansive forces) upon a change in temperature due to the differences in linear coefficient of thermal expansion.

The lever arm 290 is so constructed that, under conditions of ambient temperature, first arm portion 294 is substantially parallel to the long leg 296" of L-shaped, second arm portion 296. However, when the temperature of the fuel in regulator chamber 44 reaches a point where substantial vaporization of fuel can be expected, e.g., about 135° F.–140° F., the bimetallic strip comprising first arm portion 294 will bend away from conduit 82 (FIG. 1) as shown by the dotted lines in FIG. 2.

In a second embodiment, FIG. 3 illustrates a lever arm, generally indicated as 390, comprising a first arm portion, generally indicated as 394, and a second arm portion, generally indicated as 396, of a generally L-shape. The short leg of the L 396' is connected to the first arm portion 394 through bushing 398 provided with bore 392 which is receivable of pin 92 for pivotally mounting the lever arm 390 within the regulator chamber 44 of the carburetor 1. The long leg 396", of L-shaped second arm portion 396, is constructed of an upper half 396A and a lower half 396B. One of the halves, 396A or 396B, is integrally formed with short leg 396', bushing 398 and first arm portion 394. The so-formed integral body is made of a first metal having a predetermined linear coefficient of thermal expansion. The remaining half, 396B or 396A, respectively, comprises a metallic strip, formed of a second metal having a predetermined linear coefficient of thermal expansion different from that of said first metal, bonded to the other half. The two bonded halves forming a bimetallic strip, as previously described.

The lever arm 390 is so constructed that, under conditions of ambient temperature, first arm portion 394 is substantially parallel to the long leg 396" of L-shaped, second arm portion 396. However, when the temperature of the fuel in regulator chamber 44 reaches a point where substantial vaporization of fuel can be expected, e.g. about 135° F.–140° F., the bimetallic strip comprising long leg 396" will arch causing fist arm portion 394 to rotate about pivot pin 92 (FIG. 1), contained in bore 392, away from conduit 82 (FIG. 1), as shown by the dotted lines in FIG. 3.

In a third embodiment, FIG. 4 illustrates a lever arm, generally indicated as 490, comprising a first arm portion, generally indicated as 494, and a second arm portion, generally indicated as 496, of a generally L-shape. The short leg of the L 496' is connected to the first arm portion 494 through bushing 498 provided with bore 492 which is receivable of pin 92 (FIG. 1) for pivotally mounting the lever arm 490 within the regulator chamber 44 of the carburetor 1 (FIG. 1). The first arm portion is constructed of an upper half 494A and a lower half 494B. One of the halves, 494A or 494B, is integrally formed with the bushing 498 and short leg 494'. The long leg 496", of L-shaped second arm portion 496, is constructed of an upper half 496A and a lower half 496B. One of the halves, 496A or 496B, is also integrally formed with short leg 496' and bushing 498. The so-formed integral body of one of the long leg halves, 496A or 496B, short leg 496', bushing 498 and one of the first arm portion halves, 494A or 494B, is made of a first metal having a predetermined linear coefficient of thermal expansion. The remaining long leg half, 496B or 496A, respectively, comprises a metallic strip, formed of a metal having a predetermined linear coefficient of thermal expansion different from that of said first metal, bonded to the other half of the first arm portion, 494B or 494A, respectively, comprises a metallic strip, formed of a metal having a predetermined linear coefficient of thermal expansion different from that of said first metal, bonded to the other half of first arm portion 494. These metallic strips bonded to the integral body may be made of the same metal or each may be made from a different metal, so long as each is made of a metal having a different coefficient of thermal expansion from that of said integral body. Each of long leg 496" and first arm portion 494 thereby forms a bimetallic strip, as previously described.

The lever arm 490 is so constructed that, under conditions of ambient temperature, first arm portion 494 is substantially parallel to the long leg 496" of L-shaped, second arm portion 496. However, as the temperature of the fuel in regulator chamber 44 (FIG. 1) rises to a point where substantially vaporization of fuel can be expected, e.g., about 135° F.–140° F., the bimetallic strip comprising long leg 496" will arch causing first arm portion 494 to rotate about pivot pin 92 (FIG. 1), contained in bore 492, away from plug 84 (FIG. 1); and, simultaneously, the bimetallic strip comprising first arm portion 494 will bend away from conduit 82 (FIG. 1), as shown by the dotted lines in FIG. 4.

While the present invention has been illustrated with the preferred embodiment of the lever arm incorporating a bimetallic temperature-sensitive element, other embodiments such as the replacement of spring 98 by a temperature-sensitive spring which will retract upon increase in temperature or the provision of an additional temperature-sensitive element counteracting the bias of spring 98 can be utilized.

Turning again to FIG. 1, in normal operation, crankcase pressure pulsations (alternate gas pressure and partial vacuum developed in the crankcase of the engine during each cyclic stroke of the piston, e.g., in a two-cycle engine) are transmitted through passage 60 to crankcase chamber 52. These pulsations cause common flexible wall 61 to move back and forth, thereby transmitting alternate pressure and partial vacuum pulsations to fuel chamber 62. When a partial vacuum is formed in fuel chamber 62, fuel is drawn into chamber 62 from the fuel tank (not shown) via passage 68, conduit 70, check valve 72, valve chamber 50 and conduit 74. Simultaneously, check valve 78 prevents fuel from being drawn back from valve chamber 54 through conduit 76. When pressure is applied to fuel chamber 62, fuel is forced from the chamber through conduit 76, check valve 78, and valve chamber 54 into passage 80. Simultaneously, check valve 72 prevents fuel from being forced back into the fuel tank (not shown) through conduit 70 and passage 68. The fuel which is thus pumped to conduit 80, however, does not have sufficient pressure to unseat plug 84 and thereby pass into regulator chamber 44.

The oxygen-containing gas, from a constant pressure source of oxygen-containing gas (not shown), passing through passageway 12 undergoes a pressure reduction through venturi 14 and this pressure reduction (i.e. a pressure differential between the reduced pressure gas and the constant pressure source) is sensed by common flexible wall 49 between regulator chamber 44 (subject to the reduced pressure via main fuel nozzle 16) and air chamber 46 (subject to the constant pressure via hole 48 connected to the constant pressure source). In response to the pressure differential, flexible wall 49 moves inwardly, compressing spring 98, causing contact plate 97 to exert force on lever arm 90 thereby rotating the lever arm about pin 92. This causes plug 84 to be withdrawn from the juncture of passage 80 and conduit 82 thereby allowing fuel to pass into regulator chamber 44. As the pressure differential increases, flexible wall 49 moves further and increases the fuel flow into regulator chamber 44.

Under a first case of vapor lock conditions, elevated carburetor temperatures cause percolation of fuel in regulator chamber 44 and the fuel chamber 62. Percolation of the fuel in regulator chamber 44 vaporizes the fuel and the vapor leaks out of the idle nozzles 100, 101 and 102 and main fuel nozzle 16 until the chamber is purged of liquid fuel. Such elevated temperatures may also cause the check valves, 72 and 78, to curl and unseat and the vapor created in fuel chamber 62 forces the fuel in the fuel lines back into the fuel tank.

Once the fuel system is dry of liquid fuel, the unit cannot be restarted without the use of the choke for the following reasons:

(1) The flexible wall 49 relies on liquid fuel to form a capillary seal to check valve 38. Without liquid fuel in regulator chamber 44, inlet engine air bleeds through the main nozzle 16 and flexible wall 49 is unable to move sufficiently to disengage plug 84 from blocking the fuel inlet.

(2) The pumping action of fuel chamber 62, when operating with liquid fuel, is insufficient to dislodge plug 84. It is unknown what pressure is attainable when pumping vapor (although presumably less than when pumping liquid).

Alternatively, under a second case of vapor lock conditions, the engine will restart, however, it merely idles and will not accelerate. This indicates the following conditions exist:

A. The plug 84 is allowing enough liquid fuel to enter regulator chamber 44 to maintain idle, but the chamber may only be about half full of liquid fuel.

B. When the engine is accelerated, there is only enough fuel to accelerate and the engine "leans" out because the capillary seal to the main nozzle 16 breaks down and venturi suction to flexible wall 49 is lost and plug 84 cannot be moved to allow additional fuel into regulator chamber 44.

Use of the choke applies full engine vacuum to the flexible wall 49, thus purging the vapor and forcing the movement of plug 84 to allow liquid fuel to enter the regulator chamber 44. However, the use of the choke, as previously noted, is a tiresome procedure, not suited for the day-to-day operation of a portable power tool such as a chain saw.

The present invention overcomes these difficulties by the provision of a temperature-sensitive lever arm 90, as illustrated and described with respect to FIGS. 2–4.

In particular, plug 84 has a resilient tapered nose 86 which is forced into the junction of passage 80 and conduit 82 by the predetermined force exerted by spring 98 on lever arm 90.

In the first case, above, as the carburetor heats up, after an engine shutdown, and concomitantly the fuel contained in regulator chamber 44, the temperature-sensitive lever arm of the present invention will bend and/or rotate away from conduit 82 thereby reducing the force applied to resilient nose 86 of plug 84 (i.e. the bending and/or rotation of the lever arm produces a resistive force, directed opposite to the force applied by spring 98 on plug 84 through lever arm 90). Thus, upon hot restart (vapor lock conditions), the differential pressure necessarily applied on flexible wall 49 in order to move plug 84 is lessened, thereby overcoming the loss of differential pressure brought about by air bleed through the main nozzle 16. At high temperatures, the bending and/or rotation of the temperature-sensitive lever arm may actually overcome the force of spring 98 and open the fuel inlet. As fresh fuel enters the carburetor, upon restart, the temperature of the carburetor will be lowered (as will the temperature of the fuel therein) and the temperature-sensitive lever arm will revert to its normal configuration, as previously described.

In the second case above, the bending and/or rotation of the temperature-sensitive lever arm causes plug 84 to move and increase the opening for fuel flow thereby allowing additional fuel into regulator chamber 44 to purge it of vapor, i.e. the temperature-sensitive lever arm controls the fuel flow in response to temperature. As in the previous case, as fresh fuel enters the carburetor, cooling the carburetor and the fuel contained therein, the temperature-sensitive lever arm will revert to its normal configuration.

In both of the above cases, the flexible wall 49 aids the temperature-sensitive lever arm in providing an additional resistive force to overcome the force of spring 98 by virtue of the pressure differential applied across the wall and/or by controlling fuel flow in response to the pressure differential across the wall (reduced pressure gas in passage 12 versus constant pressure gas in air chamber 46) by moving plug 84.

What is claimed is:

1. A diaphragm carburetor for supplying a mixture of an oxygen-containing gas and a liquid, at least partially vaporizable fuel to an internal combustion engine having a crankcase comprising:

passage means for introducing an oxygen-containing gas, having a given pressure, into the internal combustion engine;

pressure reducing means, operably connected to said passage means, for reducing the pressure of said gas;

fuel mixing means, operably connected to said pressure-reducing means, for mixing said fuel with said reduced pressure gas;

fuel control means for supplying a controlled amount of said fuel to said fuel mixing means; and throttle means, operably connected to said passage means, for controlling the amount of said mixture of said gas and said fuel supplied to said internal combustion engine;

wherein said fuel control means comprises fuel regulator means for containing a predetermined quantity of said fuel;

fuel inlet means for supplying a controlled amount of said fuel to said fuel regulator means;

fuel outlet means for supplying fuel from said fuel regulator means to said fuel mixing means;

pressure control means, operatively connected to said fuel inlet means, for varying the amount of fuel fed to said fuel regulator means from said fuel inlet means in response to the pressure differential between said reduced-pressure gas and said gas having a given pressure; and temperature control means, operatively connected to said fuel inlet means, for varying the amount of fuel fed to said fuel regulator means from said fuel inlet means in response to the temperature of said fuel in said fuel regulator means.

2. The carburetor as claimed in claim 1, wherein said oxygen-containing gas is air and said given pressure is ambient atmospheric pressure.

3. The carburetor as claimed in claim 1, wherein said fuel inlet means, said pressure control means and said temperature control means cooperate to supply a predetermined amount of said fuel, in liquid form, to said fuel regulator means in response to the controlled amount of said mixture of said gas and said fuel supplied to said internal combustion engine as determined by said throttle means.

4. The carburetor as claimed in claim 1, wherein said fuel inlet means comprises fuel pump means, operably connectable to a source of liquid, at least partially vaporizable fuel, for pumping fuel to said fuel regulator means; and fuel valve means for passing a controlled quantity of said fuel from said fuel pump means to said fuel regulator means.

5. The carburetor as claimed in claim 4, wherein said fuel regulator means comprises a first chamber and a second chamber separated by a first common flexible wall; said first chamber communicably connectable with said oxygen-containing gas having a given pressure; said second chamber communicably connected to said fuel outlet means and said fuel valve means.

6. The carburetor as claimed in claim 4, wherein said fuel pump means comprises a third chamber and a fourth chamber separated by a second common flexible wall; said third chamber communicably connectable with the crankcase of said intenal combustion engine; said fourth chamber having a fuel inlet receivably communicating with said source of fuel and a fuel outlet communicating with said fuel valve means; said fuel inlet provided with inlet check valve means for allowing fuel flow into said fourth chamber and preventing fuel flow out of said fourth chamber; said fuel outlet provided with outlet check valve means for allowing fuel flow out of said fourth chamber and preventing fuel flow into said fourth chamber.

7. The carburetor as claimed in claim 4, wherein said temperature control means and said pressure control means are each operably connected to said fuel valve means.

8. The carburetor as claimed in claim 4, wherein said fuel valve means comprises conduit means of predetermined open cross-section, having an axis, for passing fuel from said fuel pump means to said fuel regulating means; and plug means, movable along the axis of said conduit means, for closing to fuel flow at least a portion of the open cross-sectional area of said conduit means, the degree of closure of said open cross-sectional area being determined by the axial position of said plug.

9. The carburetor as claimed in claim 8, wherein said pressure control means comprises means for sensing the pressure differential between said reduced-pressure oxygen-containing gas and said oxygen-containing gas having a given pressure; and means for axially moving said plug means in response to said sensed pressure differential.

10. The carburetor as claimed in claim 8, wherein said temperature control means comprises means for sensing the temperature of said fuel; and means for axially moving said plug means in response to said sensed fuel temperature.

11. The carburetor as claimed in claim 1 wherein said fuel inlet means comprises fuel passage means for passing fuel to said fuel regulator means;

fuel pump means for supplying fuel to said fuel passage means;

valve means, operably connected to said fuel passage means, for controlling the flow of fuel through said fuel passage means, said valve means having a closed position whereby fuel is prevented from flowing through said fuel passage means and an open position whereby fuel is allowed to flow through said fuel passage means; and biasing means for applying a predetermined force to said valve means to yieldably urge said valve means to said closed position.

12. The carburetor as claimed in claim 11, wherein said pressure control means comprises means for sensing the pressure differential between said reduced-pressure oxygen-containing gas and said oxygen-containing gas having a given pressure and generating a first resistive force in response to said sensed pressure differential, said first resistive force being applied to said valve means opposite to the force applied by said biasing means.

13. The carburetor as claimed in claim 12, wherein said temperature control means comprises means for sensing the temperature of said fuel and generating a second resistive force in response to said sensed temperature, said second resistive force being applied to said valve means opposite to the force applied by said biasing means.

14. The carburetor as claimed in claim 13, wherein said fuel regulator means comprises a first chamber and second chamber separated by a first common flexible wall, said first chamber being communicably connectable with said oxygen-containing gas having a given pressure, said second chamber communicating with said fuel outlet means and said fuel passage means.

15. The carburetor as claimed in claim 14, wherein said valve means comprises a conduit having a front end and a rear end, said front end operably connected to said fuel passage means and said rear end operably connected to said second chamber; a plug means, movable within said conduit, for preventing fuel passage through said conduit when moved to the front end of said conduit and allowing fuel passage through said conduit when moved away from the front end of said conduit, said plug means having a front end and a rear end, said front end of said plug means being adapted to seal the operable connection between said fuel passage means and said conduit.

16. The carburetor as claimed in claim 15, wherein said means for generating a first resistive force comprises a metallic lever pivotally mounted within said second chamber; said lever, on one side of said pivot, being operably connected to said rear end of said plug means and, on the other side of said pivot, being operably connected to said first common flexible wall, being formed of a first metal having a predetermined linear coefficient of thermal expansion.

17. The carburetor as claimed in claim 16, wherein said means for generating a second resistive force comprises at least one metallic strip bonded to said lever, on at least one side of said lever, relative to said pivot; said at least one metallic strip formed of a metal having a predetermined linear coefficient of thermal expansion different from that of said first metal; said metallic strip and said lever forming in combination a bimetallic strip which upon change in temperature will undergo force-producing deformation due to the differences in linear coefficient of thermal expansion between said first and second metals.

18. The carburetor as claimed in claim 17, wherein a metallic strip is bonded to said lever on the side of said lever, relative to said pivot, operably connected to said rear end of said plug means.

19. The carburetor as claimed in claim 17, wherein a metallic strip is bonded to said lever on the side of said lever, relative to said pivot, operably connected to said first common flexible wall.

20. The carburetor as claimed in claim 17, wherein a metallic strip is bonded to said lever on the side of said lever, relative to said pivot, operably connected to said rear end of said plug means, and a metallic strip is bonded to said lever on the side of said lever, relative to said pivot, operably connected to said first common flexible wall.

21. The carburetor as claimed in claim 17, wherein said biasing means comprises a spring mounted within said second chamber and operably connected to said lever.

22. The carburetor as claimed in claim 17, wherein said fuel pump means comprises a third chamber and a fourth chamber separated by a second flexible diaphragm; said third chamber communicably connectable with the crankcase of said internal combustion engine; said fourth chamber having a fuel inlet receivably communicating with a source of fuel and a fuel outlet operably communicating with said fuel passage means; said fuel inlet provided with inlet check valve means for allowing fuel flow into said fourth chamber and preventing fuel flow out of said fourth chamber; said fuel outlet provided with outlet check valve means for allowing fuel flow out of said fourth chamber and preventing fuel flow into said fourth chamber.

23. A diaphragm carburetor for supplying a mixture of an oxygen-containing gas and a liquid at least partially vaporizable fuel to an internal combustion engine comprising:

gas/fuel mixing means for mixing an oxygen-containing gas with said fuel in predetermined proportions;

fuel supply means for supplying said fuel to said gas/fuel mixing means, said fuel supply means comprising a chamber, communicably connected to said gas/fuel mixing means, for containing a predetermined quantity of said fuel and a valve for controlling the introduction of said fuel into said chamber;

means for opening said valve during engine operation in response to operating conditions; and means for opening said valve in response to fuel temperature when said engine is stopped and fuel in said chamber starts to vaporize.

24. The carburetor as claimed in claim 23, wherein said means for opening said valve during engine operation is responsive to the pressure of said fuel in said chamber.

25. A carburetor for supplying a mixture of an oxygen-containing gas and a liquid at least partially vaporizable fuel to an internal combustion engine having a crankcase comprising:

a passage for introducing an oxygen-containing gas, having a given pressure, to the engine;

a venturi within said passage for reducing the pressure of said gas;

a fuel nozzle for spraying fuel into said reduced pressure gas, whereby said fuel and said gas are admixed;

a first chamber and a second chamber separated by a first flexible diaphragm, said first chamber in open communication with said oxygen-containing gas having a given pressure and said second chamber in open communication with said fuel nozzle;

a third chamber and a fourth chamber separated by a second flexible diaphragm, said third chamber in open communication with said crankcase and said fourth chamber having a fuel inlet receivably communicating with a source of fuel and a fuel outlet in open communication with a fuel passage, said fuel inlet provided with an inlet check valve for allowing fuel flow into said fourth chamber and preventing fuel flow from said fourth chamber, said fuel outlet provided with an outlet check valve for allowing fuel flow into said fuel passage and for preventing fuel flow into said fourth chamber;

a conduit having a front end and a rear end, said front end in open communication with said fuel passage and said rear end in open communication with said second chamber;

a plug, movable within said conduit, for preventing fuel flow through said conduit when moved to the front end of said conduit and allowing fuel passage through said conduit when moved away from the front end of said conduit, said plug having a front end and a rear end, said front end being adapted to seal the connection between said fuel passage and said conduit;

a metallic lever pivotally mounted within said second chamber, said lever, on one side of said pivot, connected to said rear end of said plug and, on the other side of said pivot, connected to said first flexible diaphragm, said lever being formed of a first metal having a predetermined linear coefficient of thermal expansion;

at least one metallic strip bonded to said lever, on at least one side of said lever relative to said pivot, said at least one metallic strip formed of a metal having a predetermined linear coefficient of thermal expansion different from that of said first metal, said metallic strip and said lever forming in combination a bimetallic strip which upon increase in temperature will undergo deformation so as to move said plug away from said front end of said conduit; and a spring mounted within said second chamber to apply force to said lever so as to yieldably urge said plug to said front end of said conduit.

* * * * *